US006446299B1

(12) United States Patent
Kaleta

(10) Patent No.: US 6,446,299 B1
(45) Date of Patent: Sep. 10, 2002

(54) WRINGABLE MOP WITH PIVOTING SCRUBBER HEAD

(76) Inventor: Bryan Kaleta, 1037 Hinswood Dr., Darien, IL (US) 60561

( * ) Notice: Subject to any disclaimer, the term of this patent is extended or adjusted under 35 U.S.C. 154(b) by 0 days.

(21) Appl. No.: 09/812,670

(22) Filed: Mar. 20, 2001

(51) Int. Cl.[7] ..... A47L 13/12; A47L 13/144
(52) U.S. Cl. ..... 15/119.2; 15/116.2; 15/118
(58) Field of Search ..... 15/116.1, 116.2, 15/118, 119.1, 119.2

(56) References Cited

U.S. PATENT DOCUMENTS

| | | | |
|---|---|---|---|
| 2,651,069 A | | 9/1953 | Hoffman |
| 2,730,744 A | | 1/1956 | Vaughn |
| 2,896,235 A | | 7/1959 | Clements |
| 2,947,014 A | | 8/1960 | O'Connor et al. |
| 3,008,163 A | | 11/1961 | Bommer |
| 4,196,488 A | | 4/1980 | Barry |
| 4,491,998 A | | 1/1985 | Wilson et al. |
| 5,438,727 A | | 8/1995 | Specht |
| 6,026,530 A | * | 2/2000 | Camp, Jr. |
| 6,216,307 B1 | * | 4/2001 | Kaleta |
| 6,305,042 B1 | * | 10/2001 | Lalli |

* cited by examiner

*Primary Examiner*—Randall E. Chin
(74) *Attorney, Agent, or Firm*—Knechtel, Demeur & Samlan

(57) ABSTRACT

A hand held cleaning device that has a self wringing mechanism for extracting liquids from a sponge mounted at the end of an elongated handle. A sleeve is mounted on the handle and slides from a first position to a second position. When moved to the second position, it operates a wringing assembly mounted on a lever mechanism. There is a second cleaning element mounted on a moveable frame member that pivots and wrings the liquid from the sponge and moves the second cleaning element over the first cleaning element. In this second position, the moveable frame is positioned between the sponge and the second cleaning element with the second cleaning element contacting the surface to be cleaned.

17 Claims, 3 Drawing Sheets

12
30
40
46
50
44
50
42
41
58
80
52
36
76
48
38
54
34
72
56
16
20
70
68
18
22
74
62
78
32
A
24
25

12
42
30
41
36
40
34
16
18
48
24
60
44
62
78
80
76
70
72
74

WRINGABLE MOP WITH PIVOTING SCRUBBER HEAD

BACKGROUND AND SUMMARY OF THE INVENTION

This invention relates to floor cleaning devices and more particularly, to a hand held mop utilizing a first cleaning element being a sponge or similar compressible absorbent cleaning element and a second cleaning element being a scrubbing cleaning element.

Numerous floor-cleaning devices have been utilized over the years. Generally they all provided a labor saving device in that they allowed the user to stand upright while placing the cleaning element in contact with the floor surface. Broadly classified, there are string mops, sponge mops and brooms. The sponge mop uses a sponge or similar compressible absorbent cleaning element for absorbing fluids and for cleaning the floor surface. There is a squeezing mechanism to remove water or other absorbed fluids from the sponge. Most of these devices have one cleaning implement, namely the sponge, contacting the floor. An improvement to these devices was the introduction of a scrubbing strip along one side of the sponge element. However the scrubbing strip was relatively narrow. The scrubber pad surface was much smaller than the surface area of the sponge.

For example, one type of wringer mop is illustrated in U.S. Pat. No. 2,730,744 issued to Vaughn on Jan. 17, 1956. This design provides for the sponge element to be folded upon itself and compressed to permit the extraction of water. Similarly, in U.S. Pat. No. 2,947,014 issued to O'Connor et al. on Aug. 2, 1960, a compressible folding sponge element is also illustrated. As can be seen, neither of these devices utilized an abrasive scrubbing strip. A problem with folding the sponge is that it results in failure of the sponge along the fold area.

One mop which does utilize either a sponge element or an abrasive element is illustrated in U.S. Pat. No. 3,008,163 to Bommer on Nov. 20, 1959. In Bommer, two mop elements are separated by a flexible partition which allows the mop elements to move or flex from one orientation to another. The sponge element is drawn up between a pair of rollers in order to have absorbed liquid removed. Even though the Bommer device illustrates two different cleaning elements on the cleaning head, the flexible support between the two cleaning elements will not allow a person to apply substantial force onto the cleaning head without the cleaning elements bending. Furthermore, it is likely that one of the wringing rollers will rub or contact the floor during the cleaning operation if sufficient force is applied downwardly by the user against the cleaning element. This is due to the fact that the cleaning elements will easily flex, causing the roller to strike the floor. Another shortcoming is that a portion of the cleaning element is always in compression between the rollers. This minimizes the usable surface of the mop head. The wringing mechanism is also complex, extending outwardly from the handle, and, thus, can catch or strike objects while mopping. All of these complexities add to the cost and possible failure of the mop and its wringing mechanism.

Another mop which provides for drawing the sponge between a pair of rollers is illustrated in U.S. Pat. No. 4,196,488, to Barry which issued on Dec. 11, 1978. However, Barry does not illustrate or use an abrasive cleaning strip nor can one easily be positioned on the sponge element.

A sponge mop with a wringing mechanism is illustrated in U.S. Pat. No. 5,438,727 to Specht which issued on Aug. 8, 1995 and is entitled Wringable Flat-Surface Sponge. This device illustrates a sponge mop having a replaceable sponge at one end. There is a manually operable wringing assembly that is operated by a lever mechanism. The lever mechanism is pivotally connected to the handle. When the lever mechanism is actuated, a roller unit rolls over the sponge to squeeze absorbed fluids from the sponge. When the lever mechanism is released, it returns to its original position, out of the way of the sponge cleaning element. This device works relatively well but it has several shortcomings just as all of the other prior described devices.

None of the devices provide a sponge mop that has a second full surface cleaning mechanism attached to the head so that either of the cleaning elements can be selectively place in contact with the floor. None of these devices use a second cleaning element such as a scrubber pad or brush that can be oriented over the sponge so that either cleaning element can be selectively placed in contact with the floor. Furthermore none of the devices provide for positioning the cleaning elements with respect to each other so that they do not interfere with the other during use.

OBJECTS AND ADVANTAGES

It is an object of the present invention to provide an improved hand held cleaning device having a base frame that supports a first compressible and absorbent cleaning element that has a wringing assembly attached to the handle. It is a related object to provide a sponge mop having a unique wringing mechanism.

Another object is to provide a cleaning device having the first cleaning element mounted on the base frame and a second cleaning element that can be oriented between the first cleaning element and the surface to be cleaned. A related object is to provide a unique pivoting mechanism that moves the second cleaning element from its non-cleaning position into its cleaning position at the same time that it squeezes absorbed fluids from the sponge.

Yet another object is to provide a cleaning device that has a second cleaning element that pivots into its cleaning position while maintaining the handle at a comfortable position for the user to perform the cleaning operation.

It is still another object to provide a cleaning device that easily allows the extraction of fluids from the sponge element without the user's hands contacting the sponge element. It is a related object to dispose the second cleaning element in the cleaning position without the user touching the second cleaning element.

Still another object is to provide a cleaning device that has a sponge cleaning element and a second scrubbing element, both having substantially the same surface area contacting the surface to be cleaned. A related object is to provide a second cleaning element that has a scrubber pad, a brush or a combination of both.

Yet another object is to provide a cleaning device that can orient either the first or second cleaning element into its cleaning position in contact with the surface to be cleaned by merely operating the wringer mechanism.

SUMMARY OF THE INVENTION

The present invention is a hand held cleaning device for cleaning floors and other flat surfaces. The user grasps an elongated handle at a top end. There is a first cleaning element that is a compressible and absorbent cleaning element such as a sponge. It is releasably mounted on a frame member that has a side for receiving and supporting the sponge. The other side of the frame member is attached to a bottom end of the elongated handle. A lever mechanism has one end pivotally connected towards the bottom end of the handle. The other end of the lever mechanism is attached to a moveable frame member. The lever mechanism is connected to a slidable sleeve or other actuating mechanism that is on the elongated handle. There is a roller unit on the moveable frame such that when the lever mechanism is actuated, the moveable frame and the roller unit move over the sponge. The roller compresses the sponge against the frame, squeezing it and removing absorbed fluids from the sponge.

A second cleaning element is attached to the moveable frame. When the lever mechanism is actuated to wring out the sponge, the moveable frame moves into a second position between the floor and the first cleaning element orienting the second cleaning element adjacent to the floor so that the second cleaning element can perform its cleaning operation. In this manner either the first or second cleaning element can be oriented in position for cleaning by moving slidable sleeve which in turn operates the lever mechanism.

BRIEF DESCRIPTION OF THE DRAWINGS

The present invention will be more clearly understood from the following Brief Description of the Drawings in which.

DESCRIPTION OF THE PREFERRED EMBODIMENT

Figure 1:
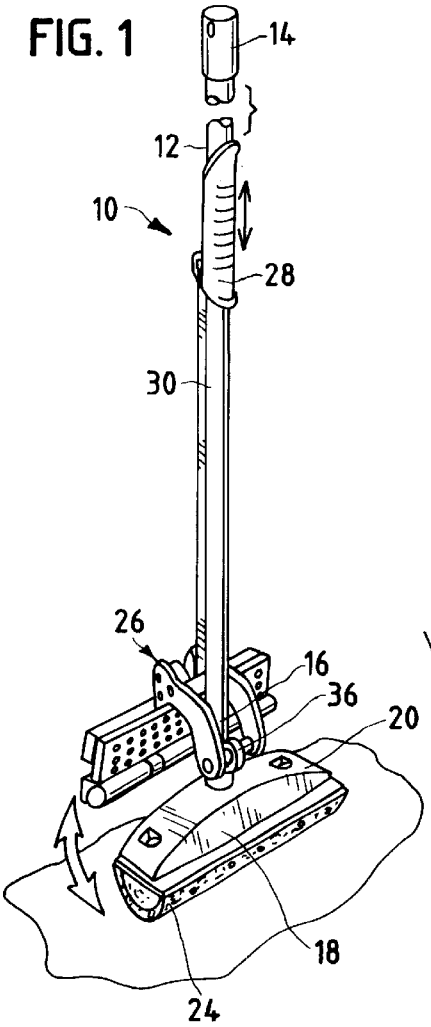
FIG. 1 is a perspective view, partially broken away, of the inventive hand held cleaning device showing the first cleaning element or sponge and wringing assembly.

Turning first to FIG. 1, a self wringing mop 10 of the present invention is illustrated. There is an elongated handle 12 having a top end 14 and a bottom end 16. The elongated handle 12 has a longitudinal axis extending along the entire length of the handle 12. The overall length of the handle 12 is approximately four to five feet. Attached to the bottom end 16 is a frame or support assembly 18 that has a top surface 20 and a bottom surface 22. The frame 18 is disposed at a convenient angle to the longitudinal axis of the handle 12 for the convenience and comfort of the user.

Mounted to the bottom surface 22 is a sponge or other compressible absorbent cleaning element 24. There is also a wringing assembly 26 attached near the bottom end 16. The wringing assembly is shown in a first non-wringing position in FIG. 1. In this position the wringing assembly does not interfere with the sponge 24 engaging and cleaning a flat surface 25. There is also a hand grip 28 mounted for limited slidable movement along the longitudinal axis of the handle 12. The hand grip may be covered with a foam cover or the like for easy grasping. The hand grip 28 is connected to the wringing assembly 26 by means of an actuating bar 30, which will be more fully described later.

Figure 2:
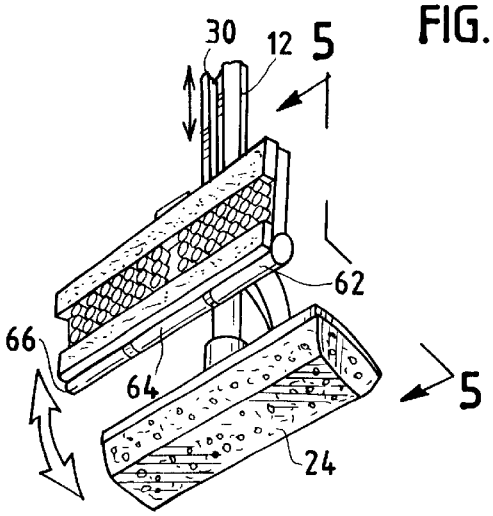
FIG. 2 is a perspective view, partially broken away, of the bottom end of the elongated handle more clearly illustrating the wringing assembly and the first and second cleaning elements.

As seen in FIG. 2, the wringing assembly 26 is in the first position wherein it is not engaging the sponge 24. In fact the wringing assembly 26 is disposed above and behind the sponge 26 so that it will not engage the surface 25 when the sponge is used in normal use to absorb liquids from the surface 25.

Figure 5:
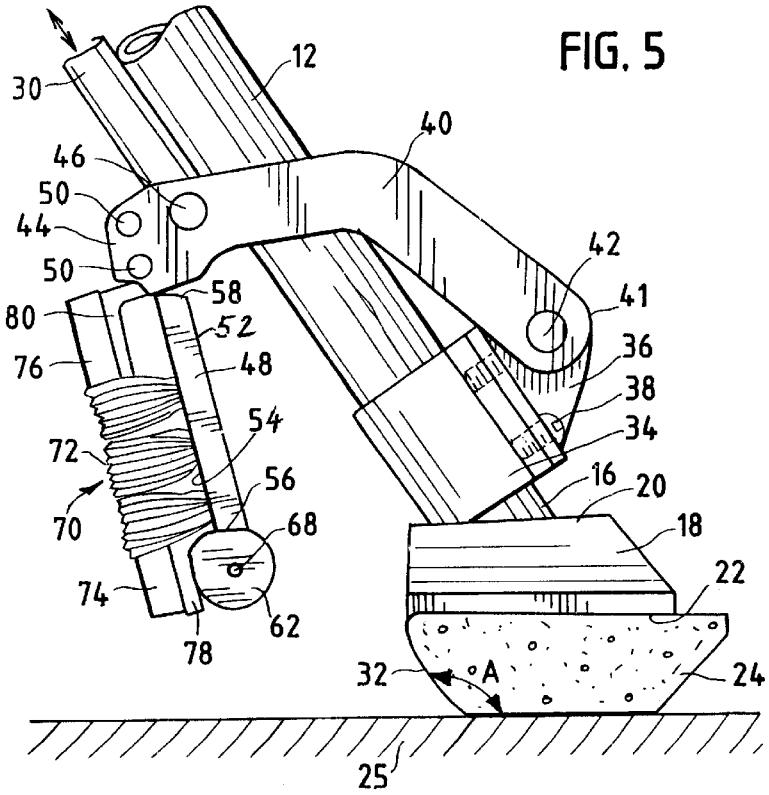
FIG. 5 is an enlarged side elevation view taken along line 5—5 of FIG. 2 of the first and second cleaning elements and the lever mechanism to operate the wringing mechanism.

The wringing assembly 26 is more clearly shown in FIG. 5, which is an enlarged side view. The bottom end 16 of the handle 12 is firmly connected to or molded into the frame 18. The sponge 24 is mounted to the bottom surface 22 of the frame 18 by releasable attachment means so that the sponge 24 can be replace if worn. The attachment means can be clips, Velcro® or other conventional means. The sponge 24 has a substantially flat bottom which when in its scrubbing position as shown in FIG. 5, will engage the normally flat surface 25. It also has a tapered rear end 32, which forms an obtuse angle "A" with the surface 25. This obtuse angle "A" improves the wringing operation.

Also adjacent to the bottom end 16 is a collar 34 mounted to the handle 12. A bracket 36 is securely fastened to the collar 34 by means of fasteners 38. The fasteners can be screws, rivets or any other conventional fastener. A pivot arm 40 has a first end 41 attached to the bracket 36 by means of a collar shaft 42. This attachment allows the pivot arm 40 to rotate or pivot with respect to the bracket 36. The arm 40 has a second end 44 opposite the first end 41. The second end 44 is attached to the actuating bar 30 by means of an actuating bar shaft 46. The actuating bar 30 is thus allowed to pivot with respect to the second end 44 of the pivot arm 40.

A moveable base frame 48 is securely connected to the second end 44 of the pivot arm 40. Rivets or other fasteners 50 are used for this attachment. In another embodiment, removable fasteners 50 may attach the moveable base frame 48, so that the moveable base frame 48 may be replaced if necessary.

The moveable base frame has an upper surface 52 and a lower surface 54 and a leading edge 56 and a trailing edge 58. Attached to the leading edge 56 is a roller unit 60 that is comprised of three individual compression rollers 62, 64 and 66. The exact number of rollers is not significant, only that the roller unit 60 extends across the entire length of the sponge 24. The roller unit 60 is mounted on a shaft 68 that is attached to the leading edge 58 of the moveable base frame 48.

The moveable base frame 48 also has a second cleaning element 70 mounted to its lower surface 54. The second cleaning element 70, as illustrated is comprised of a plurality of brushes 72 having one end fastened to the lower surface 54 and an opposite end adapted for contacting the surface 25 to be cleaned. The type of bushes selected depends on the make-up and other characteristics of the surface 25 to be cleaned. There is also a first scrubber pad 74 and a second scrubber pad 76. The scrubber pads are also attached to the lower surface 54 by means of first and second scrubber pad supports 78, 80 respectively. These can be L-shaped brackets or similar supporting brackets that have one end attached to the moveable frame 48 and have the scrubber pad attached to the surface of the other end. The length of the L-shaped bracket should be substantially the same as the length of the sponge 24 so that a maximum amount of scrubbing material can contact the surface 25 for the cleaning operation.

The second cleaning element 70 can be made of other materials or combinations thereof to provide a second cleaning element specifically designed for unique and specific applications. For example, the second cleaning element can be a scrubber type element as previously described or can be soft polishing cloths, tacky dust removing cloths, or extremely abrasive scrubbers. The particular make up is dependent on the surface 25.

Figure 3:
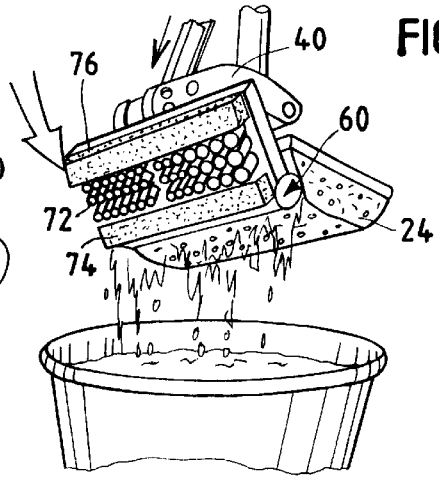
FIG. 3 is a perspective view, partially broken away, of the inventive hand held cleaning device as the wringing mechanism is initially activated and as it begins wringing fluid from the sponge.

The mop 10 is initially in the position shown in FIGS. 1 and 5. The sponge 24 contacts the surface 25 and the moveable base frame 48 and second cleaning element 70 are raised up above the surface 25 and out of the way of the sponge 24. During mopping, the sponge 24 becomes saturated with water. The user lifts the mop 10 from the surface 25 and positions the sponge 24 over a bucket or other suitable means to dispose of the absorbed fluid. This is illustrated in FIG. 3. The hand grip 28 is pushed toward the bottom end 16 to move the actuating bar 30 laterally along the elongated handle 12. The actuating bar 30 applies a force to the actuating bar shaft 46, which transfers the force to the second end 44 of the pivot arm 40. This causes the pivot arm 40 to pivot about the collar shaft 42. As the pivot arm 40 rotates toward the surface 25, the roller unit 60 engages the tapered rear end 32 of the sponge 24. This is illustrated in FIG. 3 and in phantom in FIG. 6. The user continues to apply a downward force to the hand grip 28 which causes the pivot arm 40 to continue to rotate about collar shaft 42.

Figure 4:
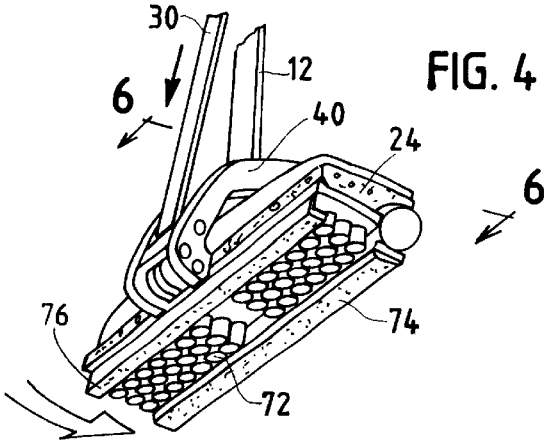
FIG. 4 is a perspective view, partially broken away, of the inventive hand held cleaning device with the wringing mechanism in the fully actuated position with t he sponge completely wrung and the second cleaning element in its cleaning position.
Figure 6:
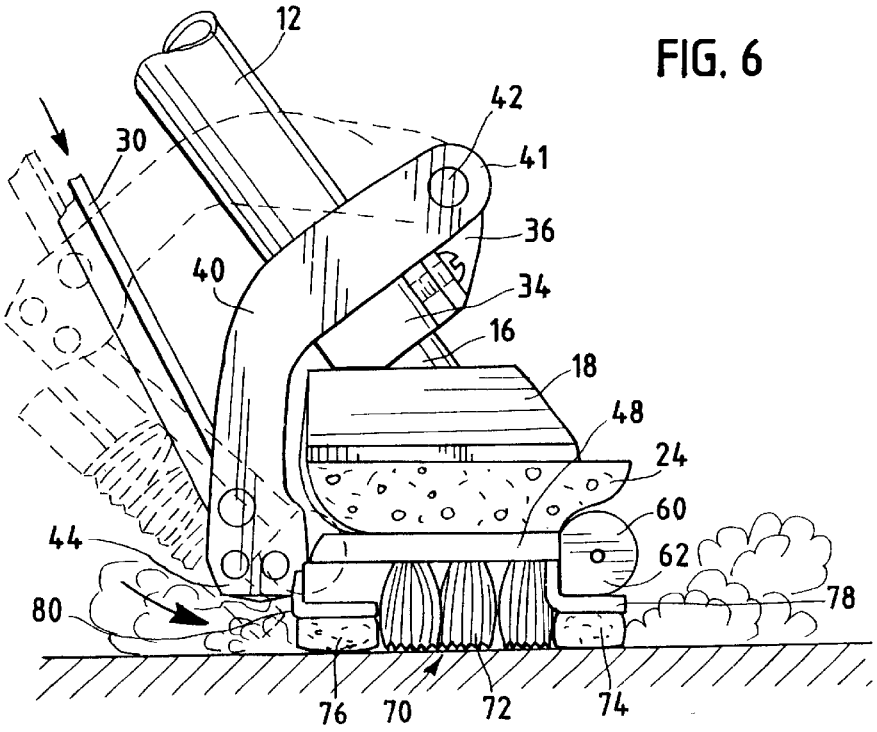
FIG. 6 is an enlarged side elevation view taken along line 6—6 of FIG. 4 showing the wringing mechanism in phantom in its first position and in a second position after the sponge is completely wrung, with the second cleaning element in its cleaning position.

The roller unit 60 progressively compresses the sponge 24 as it moves forward toward the front of the sponge. At the end of travel of the hand grip 28, the roller unit 60 reaches the front end of the sponge 24. This is shown in FIGS. 4 and 6. The moveable frame 48 is now in its second position with the lower surface 54 of the moveable frame 48 substantially parallel to the surface 25. The first and second scrubber pads 74 and 76 and the brushes 72 are all engaging the surface 25 for continuing the cleaning operation. In this second position the moveable base frame 48 is disposed between the sponge 24 and the surface 25. The user did not have to re-orient the mop by turning it over or any other re-orientation to place the second cleaning element in position for cleaning. All that the user had to do was to push the hand grip 28 downward and go through the wringing operation. The second cleaning element is automatically disposed in the proper position for scrubbing. The mop maintains the same orientation and angle for eased of operation.

When the user want to again use the sponge cleaning element, the user merely grasps the hand grip 28 and pulls up on it in a direction opposite to the initial force. The hand grip 28 pulls up on the actuating bar 30 which pulls upward the pivot arm 40 and base frame 48. The second cleaning element 70 rotates upward and out of contact with the sponge 24 until the moveable base frame 48 assumes its original position illustrated in FIG. 5. Detent means may be placed between the hand grip 28 and the handle 12 to assist in positioning and retaining the hand grip 28 in either the first or second cleaning positions. An example of a detent means is a protrusion on the handle that engages a recess on the hand grip 28. When the force applied by the user overcomes the detent force, the hand grip slides along the handle 12.

Figure 7:
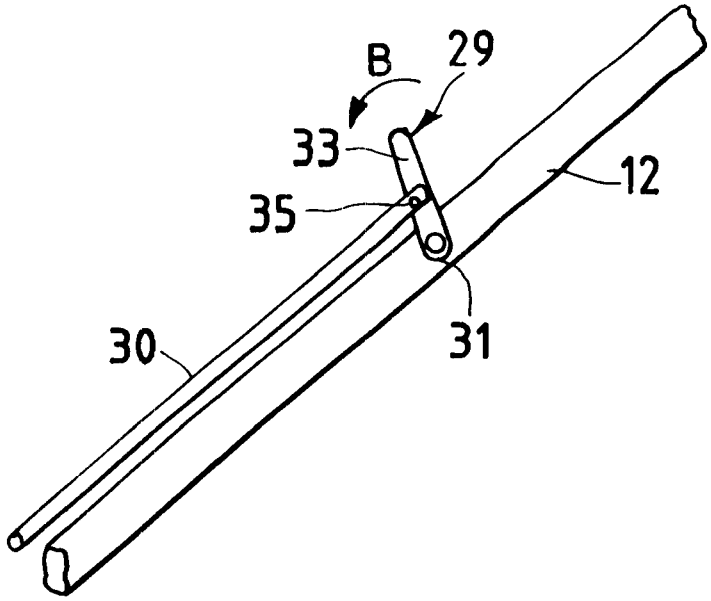
FIG. 7 is a perspective view with portions removed of an alternative actuating mechanism to operate the wringing mechanism.

In the alternative embodiment shown in FIG. 7, the hand grip 28 is replaced with a lever mechanism or pivoting handle 29. The pivoting handle 29 has one end 31 pivotally connected to the elongated handle 12. A central portion 33 is connected by a pivot connection 35 to the actuating bar 30. To wring the sponge 24, the user rotates the pivoting handle 29 in the direction of the arrow "B" to operate the actuating bar 30 in same manner as the when the user operated the hand grip 28. The pivoting handle 29 thus operates the wringer mechanism in the same manner as previously described. When the pivoting handle 29 is returned to its initial position, the actuating bar 30 is pulled back, thus withdrawing the moveable base frame from its second position back to its first position.

Conventional materials can be used to manufacture the mop components such as plastics and metals. The sponge 24 can be fastened to the support assembly by directly mounting the sponge to the support assembly or using a mounting plate disposed between the sponge and the support assembly.

While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A hand held cleaning device for cleaning a surface comprising:

a first compressible and absorbent cleaning element having a top, bottom, leading end and trailing end;

a frame having a bottom surface for receiving the top of the first cleaning element and a top surface generally opposite the bottom surface;

an elongated handle having a longitudinal axis and opposite top and bottom ends, the bottom end connected to the top surface of the frame;

actuating means connected to the elongated handle for limited lateral movement toward the top and bottom ends of the elongated handle;

a lever mechanism having first and second ends, the first end operatively connected to the actuating means and the second end pivotally connected to the bottom end of the handle;

a moveable frame having a leading edge and a trailing edge, the trailing edge connected to the lever mechanism;

compression means mounted to the leading edge of the moveable frame for progressively wringing absorbed fluid from the first cleaning element, the compression means disposed so that upon longitudinal activation of the actuating means toward the bottom end, the leading edge and the compression means progressively rolls over the trailing end of the first cleaning element toward the leading end of the first cleaning element and progressively compresses the first cleaning element from the trailing end to the leading end against the frame;

a second cleaning element secured to the moveable frame, the moveable frame disposed relative to the elongated handle so that when in a first position it does not interfere with the first cleaning element contacting the surface, and when in a second position it is disposed between the first cleaning element and the surface and the second cleaning element contacts the surface.

2. The hand held cleaning device of claim 1 wherein the actuating means comprises a sleeve slidably mounted on the handle, an actuating arm having an arm top end and an arm bottom end, the arm top end connected to the sleeve and the arm bottom end operatively connected to the first end of the lever for pivoting the lever responsive to the lateral movement of the sleeve.

3. The hand held cleaning device of claim 1 wherein the second cleaning element comprises a plurality of bristles having one end of the bristles attached to the moveable frame and the other end adapted for contacting the surface when the moveable frame is in the second position.

4. The hand held cleaning device of claim 3 and further comprising a scrubbing element attached to the moveable frame, the scrubbing element contacting the surface when the moveable frame is in the second position.

5. The hand held cleaning device of claim 4 and further comprising a second scrubbing element attached to the moveable frame, the scrubbing element attached to the leading edge of the moveable frame and the second scrubbing element attached to the trailing edge of the moveable frame with the bristles positioned between the scrubbing element and the second scrubbing element.

6. The hand held cleaning device of claim 1 wherein the bottom surface of the frame has means thereon for detachably securing the first cleaning element to the bottom surface.

7. The hand held cleaning device of claim 1 and further comprising detent means on the elongated handle associated with the first and second positions to releasably secure the actuating means to the elongated handle in the two positions.

8. The hand held cleaning device of claim 1 wherein the actuating means comprises a pivoting handle mechanism which is pivotally mounted to the handle, an actuating arm having an arm top end and an arm bottom end, the arm top end connected to the pivoting handle mechanism, the arm bottom end operatively connected to the first end of the lever for pivoting the lever responsive to the pivotal movement of the pivoting handle mechanism.

9. A hand held cleaning device for cleaning a surface comprising:

a first compressible and absorbent cleaning element;

a second cleaning element;

a frame having a bottom surface for receiving the first cleaning element and a top surface generally opposite the bottom surface;

an elongated handle having a longitudinal axis and opposite top and bottom ends, the bottom end connected to the top surface of the frame;

actuating means mounted on the elongated handle for limited lateral movement with respect to the elongated handle;

a lever mechanism operatively connected to both the actuating means and the bottom end of the handle for pivotal movement about the handle;

a moveable frame having a leading edge and a trailing edge, the trailing edge connected to the lever mechanism, a roller unit mounted to the leading edge of the moveable frame and disposed so that upon longitudinal activation of the actuating means the roller unit rolls over the first cleaning element and progressively compresses the first cleaning element against the frame, thereby progressively wringing absorbed fluid from the first cleaning element, the second cleaning element secured to the moveable frame, the lever mechanism and moveable frame adapted for movement between a first cleaning position with the first cleaning element in contact with the surface and a second cleaning position with the second cleaning element in contact with the surface;

the frame being disposed in the first cleaning position with the first compressible and absorbent cleaning element in contact with the surface, and the moveable frame positioned to not interfere with the first cleaning element contacting the surface, and the frame being disposed in the second cleaning position with the second cleaning element in contact with the surface and the moveable frame positioned between the first cleaning element and the surface.

10. The hand held cleaning device of claim 9 wherein the moveable frame has a top surface and a bottom surface and the second cleaning element is secured to the bottom surface.

11. The hand held cleaning device of claim 9 wherein the actuating means comprises a sleeve around the handle.

12. The hand held cleaning device of claim 9 wherein the second cleaning element comprises a plurality of bristles having one end of the bristles attached to the moveable frame and the other end adapted for contacting the surface when the moveable frame is in the second position.

13. The hand held cleaning device of claim 12 and further comprising a scrubbing element attached to the moveable frame, the scrubbing element contacting the surface when the moveable frame is in the second position.

14. The hand held cleaning device of claim 13 and further comprising a second scrubbing element attached to the moveable frame, the scrubbing element attached to the leading edge of the moveable frame and the second scrubbing element attached to the trailing edge of the moveable frame with the bristles positioned between the scrubbing element and the second scrubbing element.

15. The hand held cleaning device of claim 9 wherein the bottom surface of the frame has means thereon for detachably securing the first cleaning element to the bottom surface.

16. The hand held cleaning device of claim 9 and further comprising detent means on the elongated handle associated with the first and second positions to releasably secure the sleeve to the elongated handle in the two positions.

17. The hand held cleaning device of claim 9 wherein the actuating means comprises a pivoting handle connected to the handle.

* * * * *